United States Patent [19]

Goode

[11] Patent Number: 4,949,412

[45] Date of Patent: Aug. 21, 1990

[54] CLOSED LOOP FEEDBACK AIR SUPPLY FOR AIR SUPPORT BEDS

[75] Inventor: Barry L. Goode, . Humble, Tex.

[73] Assignee: Air Plus, Inc., Houston, Tex.

[21] Appl. No.: 297,626

[22] Filed: Oct. 13, 1989

Related U.S. Application Data

[63] Continuation of Ser. No. 927,498, Nov. 5, 1986, Pat. No. 4,797,902.

[51] Int. Cl.[5] ..... A61G 7/04

[52] U.S. Cl. ..... 5/453; 5/455

[58] Field of Search ..... 5/449, 453, 455, 469

[56] References Cited

U.S. PATENT DOCUMENTS

| | | | |
|---|---|---|---|
| 3,879,776 | 4/1975 | Solen | 5/453 |
| 4,542,547 | 9/1985 | Sato | 5/453 |
| 4,638,519 | 1/1987 | Hess | 5/469 X |
| 4,686,722 | 8/1987 | Swart | 5/455 X |
| 4,694,520 | 9/1987 | Paul et al. | 5/453 |
| 4,722,105 | 2/1988 | Douglas | 5/453 |
| 4,768,249 | 9/1988 | Goodwin | 5/455 |
| 4,797,962 | 1/1989 | Goode | 5/453 |

*Primary Examiner*—Michael F. Trettel

[57] ABSTRACT

A closed loop feeback-controlled air supply system for air support convalescent beds having groups of air sacs for supporting various body sections of a patient. The air supply system may be self-contained with its own air supply compressor or it may utilize any other source of compressed air. The air supply is coupled with a distributor manifold from which extends a plurality of air supply lines extending to selected groups of air sacs. Servo valves controlling each of the air supply lines are automatically positioned and controlled by signals from a microprocessor, the microprocessor receiving pressure feedback monitoring signals from pressure transducers associated with each of the groups of air sacs. Between the air supply and the manifold may be provided a master control valve which may be a servo valve also activated and controlled by the microprocessor responsive to feedback signals. Where the air supply is provided by a variable speed compressor, the compressor may also be responsive to control signals from the microprocessor.

10 Claims, 2 Drawing Sheets

CLOSED LOOP FEEDBACK AIR SUPPLY FOR AIR SUPPORT BEDS

FIELD OF THE INVENTION

This invention relates generally to air support convalescent beds having groups of air sacs for support of the various sections of the human body such as the head and shoulders, back, pelvic region, thighs and feet and lower legs. More particularly, this invention is directed to a closed loop feedback air supply system for air support beds wherein air pressure within the various groups of air sacs is automatically maintained and adjusted by means of a microprocessor which is programmed with selected human body data and responds to pressure feedback signals of the groups of air sacs and imparts controlling activation to selected ones of plural servo valves, a master servo valve and an air supply compressor in order to maintain the air sacs at optimum inflation.

RELATED INVENTION

This invention is related to the subject matter of U.S. patent application Ser. No. 06/719,874, now U.S. Pat. No. 4,638,519 filed Apr. 4, 1985 in the name of Jack H. Hess and entitled FLUIDIZED HOSPITAL BED.

BACKGROUND OF THE INVENTION

For certain types of patient care, air support patient beds have been in use for a considerable period of time. For example, during skin grafting procedures and for control of decubitus ulcers, also known as pressure lesions or bedsores and the like, air support beds have been found to provide considerable patient benefit. Beds of this character, however, have a number of significant drawbacks which, in many cases, have given hospitals, rest homes and other facilities cause for concern. For example, in many cases for patient comfort and safety, it is absolutely necessary that the air sac or air cell patient support devices remain inflated at all times. In most cases, it is quite necessary that the air sacs remain inflated within a preset pressure range to provide sufficient patient/air sac contact for even distribution of forces to the patient such that forces against any part of the patient's body remain sufficiently low that pressure lesions are unlikely.

In the event the air pressure in the air sacs of an air support bed is too low, the fabric material forming the air sacs tends to wrap around the patient to an excessive extent, thus preventing ambient air form reaching a good portion of the patient's body. In this case, there is a significant tendency for the patient to perspire heavily in areas where this wrap-around effect occurs. Continuous excessive perspiration can maintain excessive moisture present at the patient's skin for extended periods of time, thus adversely affecting the comfort and eventual recovery of the patient. This wrap-around effect also tends to force the shoulders of the patient toward one another, developing a condition which can be quite uncomfortable to the patient and causes spinal trauma. Obviously, the greater the contact between the patient and the material of the air sacs, the lower the mechanical pressure between the air sac material and the contact body surface area of the patient. Though softer air sacs effectively retard the development of pressure lesions, there is an optimum pressure range for each patient which establishes a balance between protection from pressure lesions and retarding excessive perspiration.

In present air support convalescent beds, particular preset pressures are established for air distribution lines and these preset pressures are maintained by adjustable control valves at the inlet, outlet or both the inlet and outlet sections of the air sac groups. In the event an air supply line to one of the groups of air sacs should become kinked or pinched by equipment located near the convalescent bed, obviously, the preset pressure within its particular group of air sacs will be improper. Moreover, there is no efficient procedure for detecting improper pressure settings in given air sac groups except upon visual inspection by nursing personnel. A condition of improper inflation can exist for an extended period of time, doing significant harm to the patient. The present invention also addresses this particular area of importance.

Another drawback of conventional air support bed systems arises in the event of emergency conditions, such as cardiac arrest for example. In the event of cardiac arrest, it is frequently necessary for nursing personnel to conduct cardiac pulmonary resuscitation (CPR) activities. These activities cannot be conducted efficiently on soft platforms as are typically provided by air support convalescent beds. In this case, the patient must sometimes be moved rapidly to the floor or to a stable platform to enable CPR activities to be conducted. The additional trauma caused by rapid patient transfer is detrimental to the safety and health of the patient. presently available air support bed systems are quite slow to render to a stable platform condition. In one such system, the blower must be deenergized and the air supply hose removed from the air supply manifold before the air sacs can be rapidly deflated. It is desirable, therefore, to provide an air support convalescent bed system which can be selectively controlled by nursing personnel to rapidly deflate the air sacs and provide a stable platform for the patient without necessitating removal of the patient from the convalescent bed and thereby minimizing trauma to the patient.

For years, air support surfaces have been utilized to help prevent the formation of decubitus ulcers. Various strategies have been formulated by a number of companies to achieve this end. To date, the various efforts can be characterized as either air fluidized support or low air loss support surfaces. Although the present invention is directed to the low air loss support surface category, it is prudent to point out that both technologies have as their primary aim the reduction of interface pressure (between patient and support surface) by maximizing the surface area that the support surface presents to its load (the patient).

All low air loss support surfaces are similar in design. All commercially available air support beds have air sacs or air cells that number form 15 to 30 for beds of normal length, that are connected by one method or another to a common air supply such as a constant speed compressor.

Since humans differ in height, weight, age and sex, there is a corresponding difference in mass distribution that must be taken into consideration when an individual is placed on one of these support surfaces. Obviously, if a constant speed compressor is employed as an air source, then some method of limiting or enhancing air flow to various areas or sections of the support surface to accommodate low mass, or high mass body parts is needed. The typical low air loss support surface found in clinical use today consists of approximately 20 air sacs, organized into, usually, five or so groups of four to five air sacs each. Each group is assigned the task of supporting the weight of a particular body section, i. e. head, trunk, pelvic section, legs, foot section, etc. Each air sac or group of air sacs receives air from the common air source via a distribution manifold with associated in line flow control valves (one for each group of air sacs) as is evident from FIG. 1.

As can be seen from illustration 1, in one example of the prior art, the air flow to various air sac groups can be adjusted to accommodate the various mass distribution, hence weight distribution of different human patients. As the name "low air loss support surface" implies, there is a continuous flow of air crossing the air sacs through either microscopic or macroscopic openings. The inline valves are therefore adjusted to present the optimum surface area to the load (patient).

Although one present day manufacturer has made an effort to control or regulate the set pressure to an extent, its effort is only effective against a rapid rise in pressure of an air sac group, such as when a patient rolls over and sinks an elbow into a particular air sac, thereby suddenly reducing its volume and consequently increasing its pressure. This is accomplished by means of a differential pressure regulator. A differential pressure regulator will not provide appropriate pressure adjustment for the situation in which pressure is reduced rather than increased, such as when air filters become clogged or an air supply hose becomes crimped or deformed to such extent that the air supply to a group of air sacs is diminished below the volume that is required. A differential pressure regulator also fails to accommodate the situation in which the air pressure in a particular air sac group is raised in near infinitesimal increments. Virtually all of the present day manufacturers of air support beds have no means for keeping the set pressures constant.

All of the air support surface systems discussed above represent examples of an open loop regulation system in which the effects of regulation are local and minimal and cannot control the performance of the entire system. This is, in effect, nothing more than overpressure regulation via "poppit" valves as set forth in FIG. 2 also representative of the prior art.

Preset pressure must then be defined. A procedure must also be established for presetting the pressures in each of the air sac groups to present optimum surface area to the load. No current manufacturer of low loss air support beds has a sound methodology for the correct or even acceptable setting of pressures within each of the air sac groups.

It is therefore a principle purpose of the present invention to provide a novel air support surface system together with a novel methodology for the automatic setting of pressure in each air sac and/or air sac group so that each air sac and/or air sac group presents optimal or near optimal surface area to the load (patient) and to maintain this preset pressure once achieved by means of a closed loop pressure regulation system such that overpressure or underpressure deviations from the optimum are automatically corrected.

SUMMARY OF THE INVENTION

According to the preferred embodiment of the invention, a microprocessor is programmed with data reflecting the height, weight, age and sex of a patient via keypad and calculates mass distribution and hence weight distribution of the individual. The microprocessor also calculates area distribution and finally calculates the necessary internal pressure of each air sac or air sac group that would provide an interface pressure in the range of from 30 to 45 mm of mercury between the individual and the support surface. Once this pressure has been calculated and set, it is monitored by solid state pressure transducers that are connected to analog-to-digital converters which are, in turn, monitored by the microprocessor. If the air pressure in an air sac or air sac group increases above or decreases below what was calculated to be optimal, a servo valve in the air supply line for that air sac or air sac group is appropriately adjusted by the microprocessor. Where the term "servo valve" is employed, the term is intended to include servo valves which are controlled electrically, pneumatically, mechanically or by any other means. In addition, there is a master servo valve that can control the air flow to the overall system. In this system, the compressor is preferably of the constant speed type though it may take other suitable forms as well. Once the valves are set by the microprocessor in the correct relation levels to reflect equal loading of distributed body weight, the master servo valve maintains overall system pressures by appropriately adjusting air supply from the compressed air source to the distribution manifold supplying compressed air to the branch lines leading to the air sacs or air sac groups.

In another form of the invention, an alternative air support system is provided which functions according to a method that is similar to the method of the preferred embodiment except rather than measuring the internal pressure of each air sac or air sac group, the actual interface pressure is measured by a pneumatic switch that is located on the upper surface of each air sac. Each pneumatic switch is maintained at a pressure range of from 30 to 45 mm of mercury; however, this pressure range is not limiting but may be adjusted according to the needs of the patient and the design of the system. The internal pressure of these pneumatic switches is identified at the point where the switch contacts just open or just close and the pressure in the air sacs or air sac groups is maintained in the same manner as described above.

In a further embodiment of the invention, an air support bed system is provided representing another embodiment which is similar to the preferred embodiment except that when the servo valves are set according to the weight and area distribution of the patient, a servo-controlled variable speed compressor is employed instead of a servo master valve for overall system pressure control. In this case, the microprocessor is also employed to control the speed of the variable speed compressor according to feedback signals received from transducers reflecting the internal pressures of the air sacs or air sac groups.

In an even further embodiment, an air support bed system is provided which employs pneumatic switches to measure interface pressure as described above and air supply is adjusted by means of a microprocessor controlled variable speed compressor.

Another embodiment of the invention which is thought to be especially beneficial in home patient care is an air support system employing manually set or factory preset pressure control valves for each air sac or air sac group. One solid state pressure transducer may be employed to monitor one particular air sac group, such as the air sac group that supports the trunk section of the body. Since the valves are fixed in relationship to each other similar to the weight distribution of an individual, an increase or decrease in the monitored section is indicative of a like increase or decrease in air pressure throughout the entire system and is corrected again by the appropriate control of the servo master valve by the microprocessor in response to feedback signals from the single pressure transducer. In this particular embodiment, the pressure transducers may be in the form of solid state pressure transducers measuring actual air sac pressure or pneumatic switches measuring actual interface pressure.

BRIEF DESCRIPTION OF THE DRAWINGS

The invention will be fully understood by those skilled in the art from the following description and drawings in which.

DETAILED DESCRIPTION OF THE PRIOR ART

Figure 1:
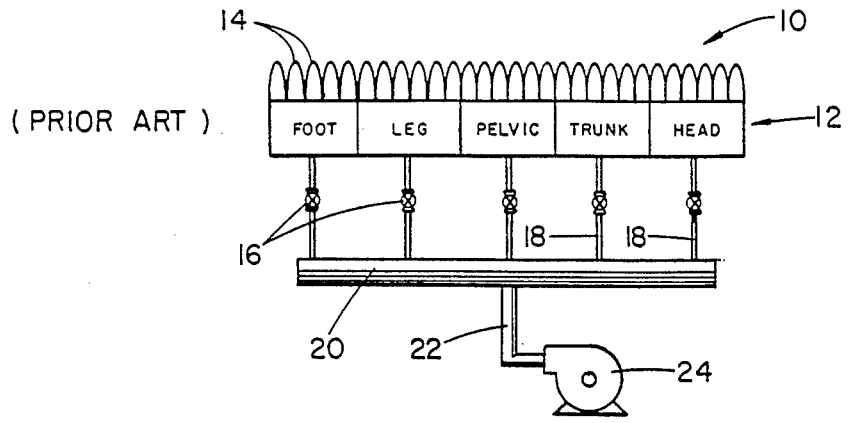
FIG. 1 is a diagrammatic illustration of an air support surface system representing one aspect of the prior art wherein air distribution and flow to groups of air sacs is accomplished by position adjustment of inline air valves.

Referring now to the drawings and first to FIG. 1, one aspect of the prior art is shown generally at 10 which includes an air support surface shown generally at 12 having sections for the foot, leg, pelvic trunk and head for supporting respective sections of a human patient. Each of the sections includes a plurality of air sacs 14. The air supply to each of the sections is such that the air sacs of particular sections will be at a particular inflation pressure which is preset by means of control valves 16 that are positioned within air supply lines 18. The air supply lines are in communication with an air distribution manifold 20 which is supplied by a primary supply line 22 from a source of compressed air such as an air compressor 24. Air is supplied via conduit 22 to the manifold 20 under a particular pressure which is established by the source of compressed air. Each of the control valves 16 in the air supply lines 18 is adjusted according to the desired inflation pressure for the air sacs of a particular air sac group. For example, the inflation pressure of the air sacs of the foot section of the patient support system will be significantly different as compared to the inflation pressure of the air sacs supporting the trunk or pelvic region of the patient. The illustration of FIG. 1 is, therefore, a basic airflow schematic diagram that is generally indicative of all currently manufactured low air loss support surface convalescent beds.

Figure 2:
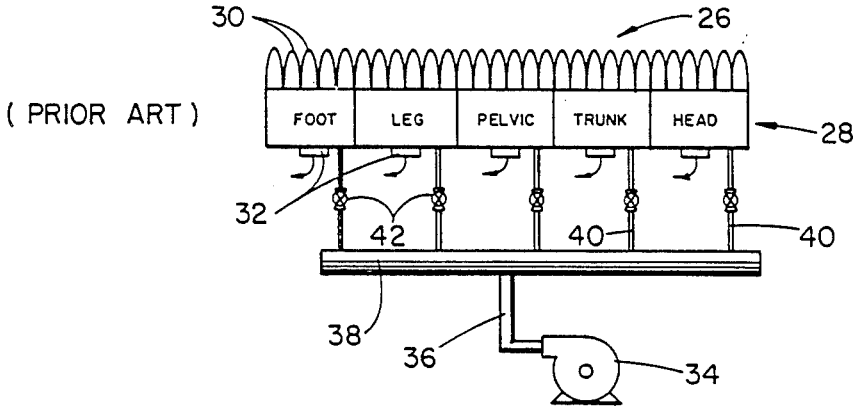
FIG. 2 is a diagrammatic illustration of another aspect of the prior art wherein poppit-type relief valves are employed in addition to inline control valves to ensure that the pressure range of the air sac groups does not exceed a preset maximum pressure.

Referring now to FIG. 2, there is schematically illustrated another air support bed construction representing another aspect of the prior art. This particular air support bed construction may be referred to as incorporating a limited method of overpressure control for maintaining operational pressure. This embodiment, illustrated generally at 26, incorporates an air bed construction 28 similar to that shown in FIG. 1 wherein multiple air sacs 30 are segregated into independent air sac groups to provide support for the feet, leg, pelvic, trunk and head regions of the patient in the manner set forth in FIG. 1. Each of the sections or air sac groups is provided with an independent adjustable relief valve such as shown at 32. The relief valves are preset at a maximum air sac pressure for each region of the air support bed. A compressor 34 or other source of compressed air is adequate to maintain an appropriate volume of air at a pressure exceeding the highest of the preset pressures of the relief valves 32. A supply conduit 36 communicates the discharge of the compressor with an air distribution manifold 38. From the distribution manifold extends a plurality of air supply lines 40 each being in communication with one of the air sac groups. Control valves 42 are provided in each of the supply lines 40 and are manually adjustable to ensure a supply of compressed air to each of the air sac groups at a pressure range slightly exceeding the overpressure settings of the respective relief valves.

The disadvantage of this particular system is that situations where pressure loss occurs in a particular air sac group will not be immediately compensated for. Though the apparatus controls or regulates the set pressure to an extent, it is only effective against a rapid rise in pressure of a particular air sac group such as when a patient rolls over and, with an elbow or knee, causes sudden and significant change in the volume of the air sac group. It does not provide pressure compensation for situations where air filters become clogged, air supply hoses become crimped or for other situations where wide pressure fluctuations are likely to occur.

DETAILED DESCRIPTION OF PREFERRED EMBODIMENTS

Figure 3:
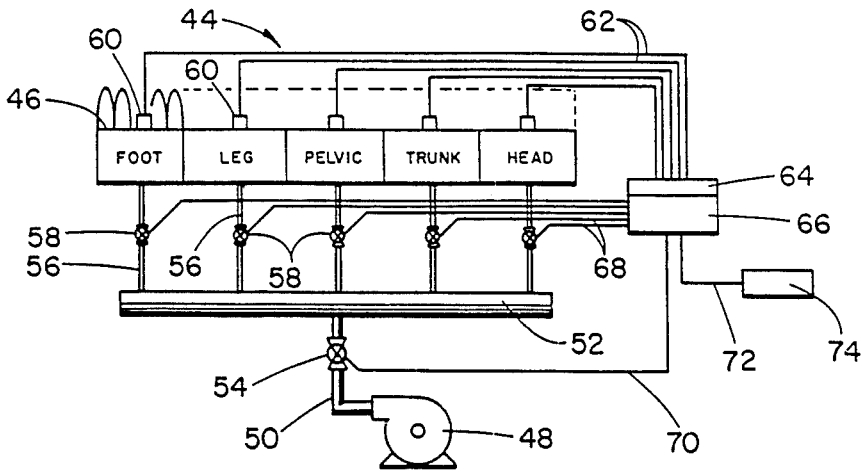
FIG. 3 is a diagrammatic illustration of an air support surface provided with a pressure control system according to the present invention.

Referring now to FIG. 3, a preferred embodiment of the present invention is shown generally at 44 by way of schematic illustration. An air support bed is provided as shown generally at 46 which, as in FIGS. 1 and 2, is partitioned into air sac groups for the foot, leg, pelvic, trunk and head regions of the patient. The air support bed system is provided with a suitable source of compressed air such as a constant speed compressor 48 which is communicated by a primary air supply line 50 to an air distribution manifold 52. The supply line 50 is provided with a master servo valve 54 for control of the volume and pressure of air supply to the air distribution manifold. A plurality of branch air supply conduits are provided as shown at 56 which communicate the air distribution manifold 52 with respective sections of the air support bed. Each of the branch conduits 56 is provided with a servo valve 58 for controlling the air supply from the manifold conduit 52 to individual sections of the air support bed.

The term "signal processor" as utilized herein is intended to mean any signal processing circuitry such as a microprocessor, state sequential logic circuit, fixed or random logic circuit, etc. Where a microprocessor is employed it should be understood that other signal processors may be employed instead. For monitoring of air pressure in each of the air sac groups, a plurality of pressure transducers 60 are positioned in communication with respective air sac groups and are connected by electrical conductors 62 to an analog-to-digital converter 64. The output of the analog-to-digital converter is received by a signal processor such as a microprocessor which is, in turn, coupled by output conductors 68 to the respective branch line servo valves 58. The signal processor or microprocessor 66 also has a master control output connected by conductor 70 to the master servo valve 54.

As mentioned above, the microprocessor 66 is programmed with data reflecting typical human body mass. For a particular patient, other program data such as height, weight, age and sex of the individual patient is programmed into the microprocessor which, in turn, calculates the mass and hence weight distribution of the individual patient. The microprocessor also calculates area distribution and finally calculates the necessary internal pressure of each air sac or air sac group that would provide a 3O to 45 mm of mercury interface pressure between the individual and the support surface. The pressure transducers 60 may conveniently take the form of solid state pressure transducers which provide pressure monitoring signals to the analog-to-digital converter 64. The pressure signals of the transducers 60 are continuously monitored by the microprocessor 66 and, in the event the pressure signal of any of the transducers is above or below the preset pressure range established by the microprocessor, the microprocessor will provide appropriate output signals to conductors 68 for position adjustment of the servo valve 58 which is associated with the particular air sac group that is involved. If the pressure of any air sac group increases or decreases beyond its pressure range as established by the microprocessor, appropriate servo valve adjustment will be automatically controlled by the microprocessor, thus increasing or decreasing air pressure to the preselected pressure range. It is not necessary for nursing personnel to monitor the equipment with any special degree of care since it is automatically controlled. In the event a malfunction occurs and the pressure range of the air support bed cannot be restored automatically under the control of the microprocessor, the microprocessor is also capable of providing an alarm signal output at conductor 72 which activates a suitable visual or audible alarm 74.

The master servo valve 54 is capable of controlling overall air supply to the air support bed system under control of the microprocessor 66. With the branch servo valves 58 stabilized by the microprocessor, the master servo valve 54 is appropriately adjusted by the microprocessor to ensure optimum supply of the volume of air required by the bed and at a pressure range which is effective to accommodate the continuous air loss that is designed into the system to provide for patient comfort and therapeutic needs.

Figure 4:
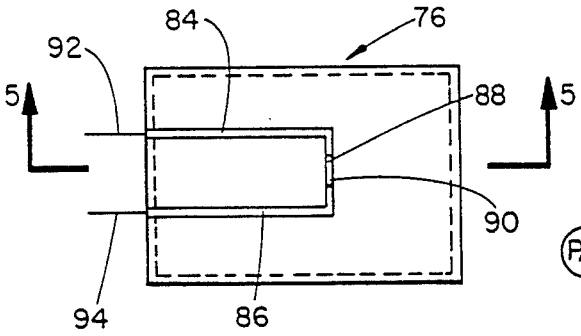
FIG. 4 is a sectional view of a pneumatic switch for measuring interface pressure of an air support surface.
Figure 5:
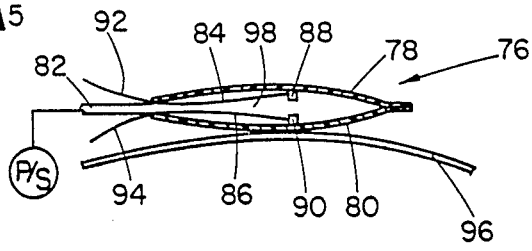
FIG. 5 is a transverse sectional view taken along line 5—5 of FIG. 4.

Referring now to FIGS. 4 and 5, there is illustrated a pneumatic switch which may be employed to measure the actual interface pressure between the load (patient) and the air support surface. This interface pressure measurement switch may be employed with any of the air support systems illustrated in FIGS. 3, 6 and 7. The pneumatic switch illustrated generally at 76 is in the form of a sealed envelope having upper and lower panels 78 and 80 that are in communication with a pneumatic source P/S via a control line 82. The inside surfaces of the envelope panels 78 and 80 are partially coated with any suitable electrically conductive material 84 and 86 which defines electrical switch conductors and switch contact portions 88 and 90. Electrical signal conductors 92 and 94 are coupled with respective switch conductors sections 84 and 86.

The pneumatic switch is intended to be positioned on the upper surface 96 of an air sac and the patient load is applied through appropriate bed covering to the switch. The switch envelope is inflated by the pressure source such that air pressure within the chamber 9B defines a preselected interface pressure. The designed interface pressure is established at the point where the switch contacts 88 and 90 just open or just close, thus providing an appropriate signal to the microprocessor via conductors 92 and 94.

The pneumatic switch 76 may be substituted for the solid state pressure transducer, thus representing an alternative embodiment of this invention which functions in the same manner as described above in connection with FIG. 3.

Figure 6:
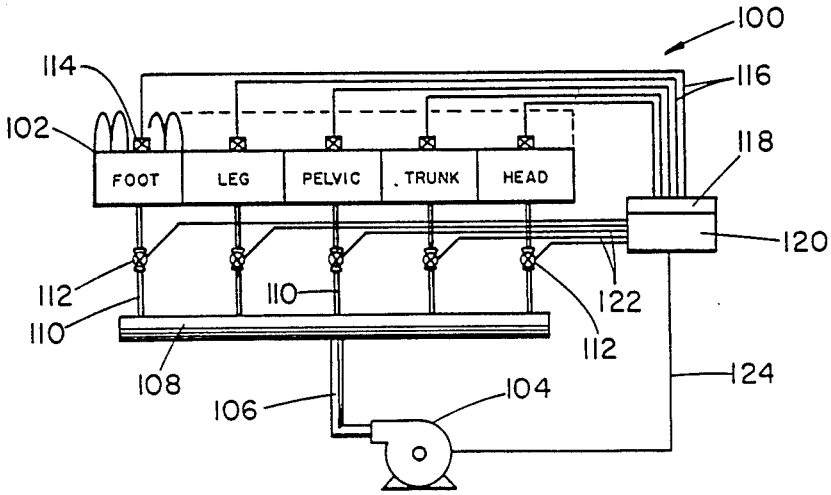
FIG. 6 is a diagrammatic illustration of an air support surface system representing another embodiment of the present invention.

Referring now to FIG. 6, another embodiment constructed in accordance with this invention is illustrated generally at 100 which includes an air support bed structure 102 having a plurality of patient support segments similar to that set forth in FIG. 3. In this particular embodiment, the air supply is in the form of a variable speed compressor 104 having connected to its discharge a main supply conduit 106 supplying compressed air to an air distribution manifold 108. Branch lines 110 extend from the air distribution manifold and are communicated with respective sections of the air support bed in the same manner as described above in connection with FIG. 3. The branch lines 110 are provided with servo valves 112 functioning in the same manner as the servo valves 58 of FIG. 3. Pressure transducers 114 monitoring the pressure of respective sections of the air support bed are communicated by signal conductors 116 to an analog-to-digital converter 118 having its output coupled with a microprocessor 120. The pressure transducers may be of the solid state type or of the pressure interface measurement type as desired. Output conductors 122 couple the output of the microprocessor with the servo valves 112, thus permitting automatic servo valve control by means of the microprocessor. An output conductor 124 of the microprocessor is coupled with the variable speed compressor 104, thus permitting the microprocessor, in response to feedback pressure signals from the transducers 114 to appropriately and automatically control the speed of the compressor 104. The compressor, therefore, provides the same function as the compressor and master servo valve shown in FIG. 3. Its speed is varied to provide the distribution manifold 108 with a volume of air flow at a particular pressure range for effective pressure control of the entire system. Individual pressure adjustments for the air sacs are also automatically controlled by positioning of the servo valves 112 responsive to signals of the microprocessor 120.

Figure 7:
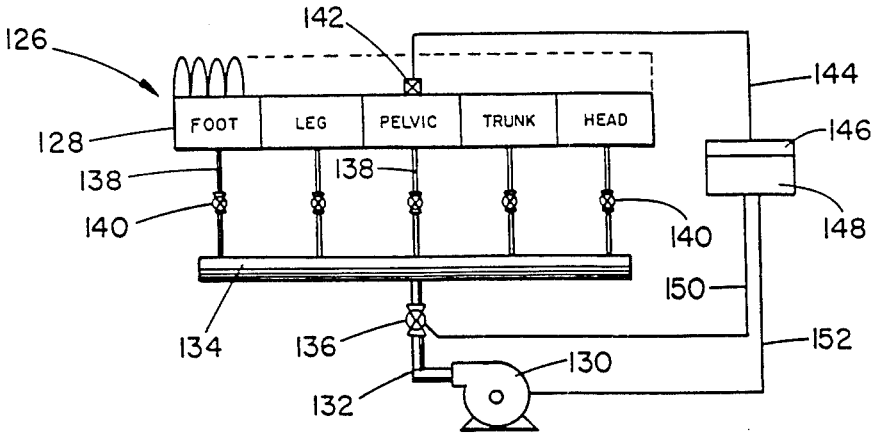
FIG. 7 is a diagrammatic illustration of an air support surface system representing an even further embodiment of this invention.

Referring now to FIG. 7, an embodiment of the invention is disclosed such as would be conveniently utilized for home care of convalescing patients. In this case, an air support bed system, illustrated generally at 126, incorporates an air support bed construction 128 of essentially the same character as set forth in FIGS. 3 and 6. A convenient air supply such as a constant or variable speed compressor 130 or a hospital air supply is communicated via a supply line 132 to an air distribution manifold 134. A master servo valve 136 is provided in the supply line 132 to maintain optimum air flow and pressure for operation of the entire air support bed system. Branch lines 138 extend from the air distribution manifold 134 to respective foot, leg, pelvic, trunk and head sections of the air support bed 128. In the branch lines are provided manually adjustable control valves 140. The manual control valves 140 are individually adjusted such as by visiting nursing personnel or are adjusted to particular settings by factory personnel according to established body mass parameters for the individual patient involved.

For controlling the air pressure within the various sections of the air support bed, a single pressure transducer is provided as shown at 142 which is in communication with a particular one of the air sac groups. As shown in FIG. 7, the pressure transducer 142 is coupled with the air sac group for support of the pelvic region of the patient. Obviously it may be coupled with any other one of the air sac groups as is appropriate for effective pressure control. The pressure transducer 142 is coupled via a conductor 144 to an analog-to-digital converter 146 having its output coupled with a microprocessor 148. A signal conductor 150 is provided to couple the output of the microprocessor with the master servo valve 136. In response to changes in air sac pressure in the pelvic section of the air support bed, an appropriate signal is fed via conductor 144 and analog-to-digital converter 146 to the microprocessor 148. The manual valves 140 remain in their respective preadjusted positions. The microprocessor appropriately adjusts the position of the master servo valve 136 to provide appropriate adjustment of the air flow and pressure to the entire air support bed. Where the compressor 130 is of the variable speed type, the microprocessor is coupled via a conductor 152 to the compressor and thus varies its speed as is appropriate for effective control of the volume and pressure of the air supply.

From the foregoing, it is apparent that this invention is one well adapted to attain all of the features hereinabove set forth together with other features which become inherent and obvious from a description of the apparatus itself.

It will be understood that the apparatus and method hereinbefore illustrated and described are given by way of example only and may be varied widely within the scope of the appended claims.

What is claimed is:

1. In a low air loss air support convalescent bed having a plurality of low air loss air sacs that are maintained within a desired pressure range and are arranged for supporting various body sections of a patent, the improvement comprising:

(a) air supply means for supplying compressed air at a pressure in excess of said desired pressure range of any of said air sacs;

(b) air distributing means for distributing compressed air from said air supply means to said plurality of air sacs;

(c) pressure control means having a plurality of manually set pressure control valves for conducting air at preset pressure ranges to individual air sacs, each of said manually set pressure control valves having a fixed orifice of selected diameter;

(d) pressure monitoring means directly and continuously monitoring the air pressure of only a selected one of said plurality of air sacs and providing pressure indicative signals; and (e) feedback means receiving said pressure indicative signals and providing pressure signals to said pressure control means, said pressure control means adjusting a master servo valve to maintain the proper pressure range throughout the bed, whereby a selected pressure between the air sacs and the patient is established.

2. A low air loss air support convalescent bed as recited in claim 1 wherein;

(a) said pressure monitoring means provides pressure responsive feedback signals for said selected one of said plurality of air sacs for pressure adjustment thereof in the event the air sac pressure of said selected one of said plurality of air sacs is outside the preset pressure range thereof; and (b) said feedback means comprises control electronics receiving said feedback signals and providing adjustment signals to said master servo valve, said control electronics being programmable with physical body parameters of the patent and providing signals to said master servo valve for establishment of the preset pressure ranges thereof.

3. A low air loss air support convalescent bed as recited in claim 1 wherein:

said pressure monitoring means comprises solid state pressure transducers monitoring internal air pressure of said selected one of said air sacs.

4. A low air loss air support convalescent bed as recited in claim 1 wherein:

said pressure monitoring means comprises load-air sac interface pressure responsive switches movable by pressure responsive means from one switch position to another switch position when air sac pressure is outside of a preset pressure range thus providing a pressure adjustment feedback signal to said feedback means.

5. A low air loss air support convalescent bed as recited in claim 1 wherein said air supply means comprises:

(a) an air compressor;

(b) a manifold conduit having branch conduits and communication with respective ones of said plurality of air sacs and being in air receiving communication with said air compressor; and (c) said plurality of manually set pressure control valves being located in respective ones of said branch conduits.

6. A low air loss air support convalescent bed as recited in claim 5, wherein:

said air compressor is a variable speed type and is controllably coupled with said feedback means, whereby the speed of said air compressor is varied responsive to output signals of said pressure monitoring means to selectively increase and decrease the air pressure in said plurality of air sacs as dictated by pressure monitored in said selected one of said air sacs, maintain optimum air pressure within each of said plurality of air sacs.

7. A low air loss air support convalescent bed as recited in claim 1, wherein:

said master servo valve is coupled between said air supply means and a manifold conduit, said master servo valve being controllably coupled with said feedback means.

8. A low air loss air support convalescent bed as recited in claim 1 wherein:

(a) each manually set pressure control valve is in communication with said distributing means and passively controls air pressure within a respective one of said plurality of air sacs;

(b) said feedback means is a microprocessor that is programmable according to body parameters of individual patients, said microprocessor being controllably coupled with said master servo valve, said master servo valve being coupled between said air supply means and said pressure control means and being controllably coupled with said microprocessor, and said master servo valve controlling the pressure of air supply to said air distributing means and being responsive to control signals of said microprocessor which control signals are in response to feedback signals generated by said pressure monitoring means.

9. A method of maintaining and adjusting inflation of the air sacs of a low air loss air support convalescent bed having multiple air sacs forming a plurality of air sac groups, comprising:

(a) supplying air from a source of compressed air having air pressure exceeding the maximum expected air pressure desired for any of said air sacs and at a volume exceeding the cumulative air loss from said air sacs;

(b) distributing by a control means compressed air to a plurality of air supply ducts, each air supply duct being in communication with one of said respective air sac groups;

(c) controlling by said control means a master servo valve, thereby controlling the pressure and volume of air flowing through each of said air supply ducts to the respective air sacs in communication therewith;

(d) sensing the air pressure in a selected one of said air sac groups and proving pressure indicating signals for said selected one of said air sac groups representing said air pressure within said selected air sac group; and (e) receiving and electronically processing said pressure indicating signals and transmitting control signals to said control means responsive to said pressure indicating signals for automatic adjustment of said master servo valve thereby controlling the respective air pressures of said air sacs.

10. The method of claim 9, wherein:

(a) said source of compressed air is a constant speed air compressor;

(b) said control means is defined by a plurality of manually set pressure control valves linked with respective groups of air sacs, and by said master servo valve linked with all of said air sacs and operatively linked with said plurality of manually set pressure control valves;

(c) said sensing of air pressure is accomplished by a pressure transducer being in sensing communication with said selective group of air sacs and transmitting pressure indicating signals; and (d) said receiving and processing said signals is accomplished by a microprocessor coupled in signal receiving relation with said pressure transducers and in position controlling relation with said master servo valve.

* * * * *